US008650776B2

(12) United States Patent
Hazenberg et al.

(10) Patent No.: US 8,650,776 B2
(45) **Date of Patent: *Feb. 18, 2014**

(54) CHANNELED SOLE FOR AN ARTICLE OF FOOTWEAR

(71) Applicant: NIKE, Inc., Beaverton, OR (US)

(72) Inventors: Klaas Pieter Hazenberg, Guangzhou (CN); Eric S. Schindler, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/850,736

(22) Filed: Mar. 26, 2013

(65) Prior Publication Data

US 2013/0212905 A1 Aug. 22, 2013

Related U.S. Application Data

(63) Continuation of application No. 12/627,521, filed on Nov. 30, 2009, now Pat. No. 8,424,225.

(51) Int. Cl.
*A43B 1/10* (2006.01)
*A43B 13/14* (2006.01)

(52) U.S. Cl.
USPC ..... 36/102; 36/103; 36/29; 36/59 R

(58) Field of Classification Search
USPC ..... 36/102, 103, 29, 59 R, 59 C, 28
See application file for complete search history.

(56) References Cited

U.S. PATENT DOCUMENTS

| | | | | |
|---|---|---|---|---|
| 7,281,343 | B2 * | 10/2007 | Riha et al. | 36/59 C |
| 7,430,817 | B2 * | 10/2008 | Abadjian et al. | 36/29 |
| 8,424,225 | B2 * | 4/2013 | Hazenberg et al. | 36/102 |
| 2002/0088145 | A1 * | 7/2002 | Clark et al. | 36/97 |
| 2005/0268490 | A1 * | 12/2005 | Foxen | 36/28 |
| 2006/0272180 | A1 * | 12/2006 | Hay | 36/25 R |
| 2008/0229617 | A1 * | 9/2008 | Johnson et al. | 36/102 |

* cited by examiner

*Primary Examiner* — Ted Kavanaugh
(74) *Attorney, Agent, or Firm* — Banner & Witcoff, Ltd.

(57) ABSTRACT

A sole structure for an article of footwear is provided. The sole structure extends longitudinally from a back edge to a front edge of the article of footwear and transversely from a medial side to a lateral side of the article of footwear. The sole structure includes an outsole having a ground-contacting layer. A first rib projects upward from the ground-contacting layer. The rib has side walls and an end wall. A channel is defined by the side walls and end wall. The channel opens downward through the ground-contacting layer and has a depth extending above the ground-contacting layer. The rib may have a multi-stage vertical stiffness profile. The sole structure may include a midsole attached to the outsole. An article of footwear having the sole structure attached to an upper is also provided.

20 Claims, 9 Drawing Sheets

CHANNELED SOLE FOR AN ARTICLE OF FOOTWEAR

RELATED APPLICATIONS

This U.S. patent application is a continuation application of and claims priority to U.S. patent application Ser. No. 12/627,521, filed Nov. 30, 2009, titled "Channeled Sole for an Article of Footwear," to Hazenberg, which is entirely incorporated herein by reference.

FIELD

Aspects of the present invention relate to a sole for an article of footwear. More particularly, various examples relate to a sole having improved flexibility and improved impact-attenuation.

BACKGROUND

To keep a wearer safe and comfortable, footwear is called upon to perform a variety of functions. For example, the sole structure of footwear should provide adequate support and impact force attenuation properties to prevent injury and reduce fatigue, while at the same time provide adequate flexibility so that the sole structure articulates, flexes, stretches, or otherwise moves to allow an individual to fully utilize the natural motion of the foot.

For example, the sport of soccer imposes special demands upon players and their footwear. During any given game, soccer players perform a wide variety of movements (e.g., running, sprinting, side-to-side, cutting, foot-planting, ball handling, kicking, goal shots, etc.). During all of these movements, pressure shifts from one part of the foot to another. Further, during many of the movements, significant impact loads may be experienced by the foot.

As another example, skateboarding requires the skateboarder to apply pressure to one or the other portions of the skateboard using his or her feet in order to control the board. This requires that skateboarders apply pressure to the board through their shoes at different locations on the bottom and edges of the shoes. For example, for some skateboarding tricks, pressure is applied along the lateral edge of the foot, approximately at the outer toe line location. For other tricks, pressure is applied on the lateral edge of the foot somewhat forward of the outer toe line location. As the interaction between the skateboarder and the skateboard is particularly important when performing such tricks, skateboarders typically prefer shoes having relatively thin and flexible soles that allow the skateboarder to "feel" the board. Additionally, however, many skateboard tricks result in impact loads being felt by the skateboarder. Thus, it is preferable that the sole also provide adequate shock attenuation to mitigate the shocks experienced by the skateboarder.

Accordingly, it would be desirable to provide footwear that allows the wearer to better feel and grip the ground or other foot-contacting surfaces, to achieve better dynamic control of the wearer's movements, while at the same time providing impact-attenuating features that protect the wearer from impacts due to these dynamic movements.

BRIEF SUMMARY

According to aspects of the disclosure, a sole structure for an article of footwear having an outsole is provided. The sole structure extends longitudinally from a back edge to a front edge of the article of footwear and extends transversely from a medial side to a lateral side of the article of footwear. The outsole has a ground-contacting layer. A first rib projects upward from the ground-contacting layer. The rib has side walls and an end wall. A channel is defined by the side walls and end wall. The channel opens downward through the ground-contacting layer and has a depth extending above the ground-contacting layer.

According to certain aspects, a minimum thickness of the end wall of the rib may be less than a minimum thickness of the side walls of the rib. According to even other aspects, at least one projection may extend upward from a top surface of the end wall of the rib.

According to certain aspects, a plurality of ribs may be provided. Even further, at least some of the plurality of ribs may intersect. According to even other aspects, a plurality of channels may be provided. At least some of the plurality of channels may intersect.

A sole structure for an article of footwear having a forefoot region, a midfoot region and a heel region is provided. The sole structure includes an outsole having a ground-contacting layer. A first rib projects upward from the ground-contacting layer. The rib has side walls. A channel is defined by the side walls. The channel opens downward through the ground-contacting layer and has a depth extending above the ground-contacting layer. According to certain aspects, at least one of the side walls may have a non-constant thickness.

A sole structure for an article of footwear includes an outsole having a ground-contacting layer, a first rib projecting upward from the ground-contacting layer, and a channel defined within the first rib. The channel opens downward through the ground-contacting layer. The first rib may have a rib height that is greater than a rib width. The first rib may also have a multi-stage vertical stiffness profile.

According to certain aspects, the first rib may have a first stiffness characteristic at the top of the rib and a second, different, stiffness characteristic at the bottom of the rib. Even further, the second stiffness characteristic may be greater than the first stiffness characteristic. According to other aspects, the channel may have a channel depth that is greater than a channel width.

An article of footwear including an upper attached to the sole structure disclosed herein is also provided.

BRIEF DESCRIPTION OF THE DRAWINGS

The foregoing Summary, as well as the following Detailed Description, will be better understood when read in conjunction with the accompanying drawings.

DETAILED DESCRIPTION

Figure 1:
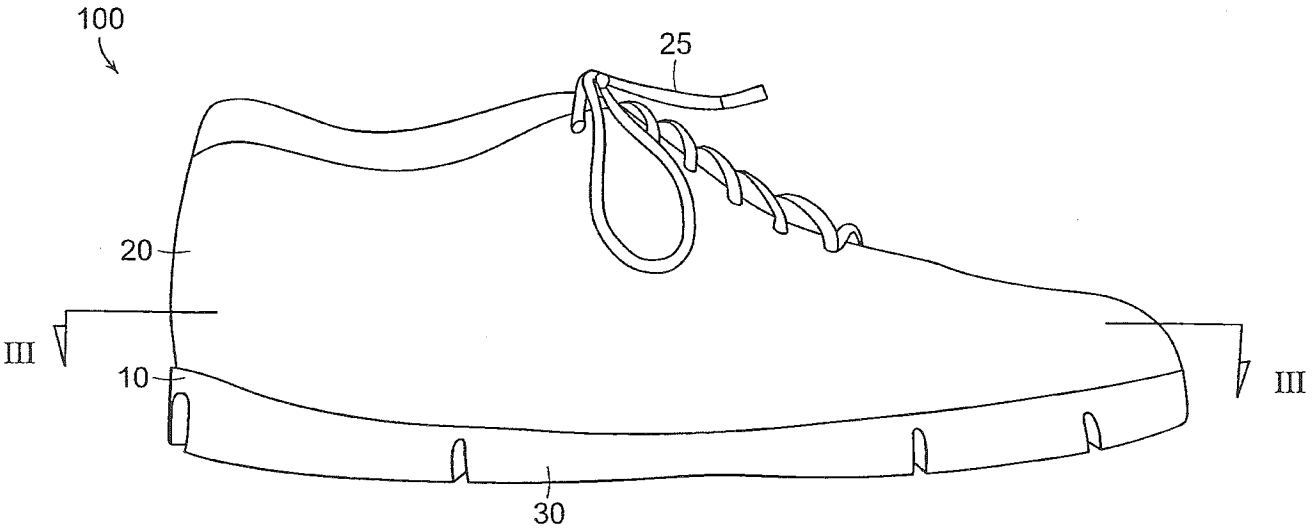
FIG. 1 is a lateral side view of an article of footwear having an upper and a sole structure in accordance with aspects of this disclosure.

The following discussion and accompanying figures disclose an article of footwear having an outsole with a rib in accordance with various embodiments of the present disclosure. Concepts related to the sole structure are disclosed with reference to an article of athletic footwear having a configuration suitable for the activity of skateboarding. The disclosed sole structure is not solely limited to footwear designed for soccer or skateboarding, however, and may be incorporated into a wide range of athletic footwear styles, including shoes that are suitable for rock climbing, bouldering, hiking, running, baseball, basketball, cross-training, football, rugby, tennis, volleyball, and walking, for example. In addition, a sole structure according to various embodiments as disclosed herein may be incorporated into footwear that is generally considered to be non-athletic, including a variety of dress shoes, casual shoes, sandals, slippers, and boots. An individual skilled in the relevant art will appreciate, given the benefit of this specification, that the concepts disclosed herein with regard to the sole structure apply to a wide variety of footwear styles, in addition to the specific styles discussed in the following material and depicted in the accompanying figures.

I. General Description of Certain Aspects

Various aspects of the disclosure relate to footwear having a channeled outsole. The article of footwear has a forefoot region, a midfoot region and a heel region. The article of footwear further has a front edge, a back edge and lateral and medial edges extending from the back edge to the front edge. The article of footwear defines a longitudinal centerline extending from the back edge to the front edge and located generally midway between the lateral edge and the medial edge.

As used herein, the modifiers "upper," "lower," "top," "bottom," "upward," "downward," "vertical," "horizontal," "longitudinal," "transverse," "front," "back" etc., unless otherwise defined or made clear from the disclosure, are relative terms meant to place the various structures or orientations of the structures of the article of footwear in the context of an article of footwear worn by a user standing on a flat, horizontal surface.

According to some aspects of the disclosure, an article of footwear is provided with a sole structure having an outsole with a ground-contacting layer and a channeled rib projecting upwardly from the ground-contacting layer. The ground-contacting layer may be a generally planar layer having a bottom, ground-contacting surface and a top, interior surface. The rib projects upwardly from the top interior surface. The channel opens downwardly through the ground-contacting layer.

The outsole may be formed of conventional outsole materials, particularly of wear-resistant materials, such as natural or synthetic rubber or a combination thereof. The material may be solid, foamed, filled, etc. or a combination thereof. One particular composite rubber mixture may include approximately 75% natural rubber and 25% synthetic rubber. The synthetic rubber could include a styrene-butadiene rubber. By way of non-limiting examples, other suitable polymeric materials for the outsole include plastics, such as PEBAX® (a poly-ether-block co-polyamide polymer available from Atofina Corporation of Puteaux, France), silicone, thermoplastic polyurethane (TPU), polypropylene, polyethylene, ethylvinylacetate, and styrene ethylbutylene styrene, etc. Optionally, the material of the outsole may also include fillers or other components to tailor its wear, durability, abrasion-resistance, compressibility, stiffness and/or strength properties. Thus, for example, the outsole may include reinforcing fibers, such as carbon fibers, glass fibers, graphite fibers, aramid fibers, basalt fibers, etc. Further, multiple different materials may be used to form the outsole. For example, a first material may be used for the forefoot region and a second material may be used in the heel region. Alternatively, a first material may be used to form the ground-contacting layer and a second material may be used to form the ribs. The outsole could be integrally molded, co-molded, laminated, adhesively assembled, etc. For example, the ground-contacting layer or a portion of the ground-contacting layer could be formed separately from the ribs and subsequently integrated therewith.

The ground-contacting layer, itself, may be formed of a single material or of multiple materials. Optionally, the ground-contacting layer may be formed of a plurality of sub-layers. For example, a relatively pliable layer may be paired with a more durable, abrasion resistant layer. By way of non-limiting examples, the abrasion resistant layer may be co-molded, laminated, adhesively attached or applied as a coating. Additionally, the material forming the outsole may be textured to impart enhanced traction and slip resistance.

Further, with respect to another aspect of the disclosure, at least a portion of the outsole may be provided with a grip enhancing material to further enhance traction and slip resistance. The grip enhancing material may provide improved gripping properties as the foot moves and rolls along the board, while the base portion of the outsole may provide long term durability and wear resistance. Further, the grip enhancing material may allow a larger area of the edge to maintain contact with the board as the foot moves and rolls along the board. Thus, for example, a relatively soft rubber or rubber-like component or a relatively soft thermoplastic material, such as a thermoplastic polyurethane (TPU), may be provided along the perimeter portion of forefoot region of the outsole. In one particular embodiment, a softer durometer rubber may form an outer layer of the outsole (e.g., a rubber having a hardness of 60 to 75 Shore A, possibly of 60 to 70 Shore A, and possibly of 64 to 70 Shore A), with a harder durometer rubber forming an inner layer (e.g., a rubber having a hardness of 70 to 90 Shore A, and possibly of 75 to 88 Shore A). Optionally, the enhanced gripping material may be co-molded, adhesively bonded, coated or otherwise provided on the outsole.

According to further aspects of the disclosure, the sole structure may include a midsole. The midsole may be secured to the edges of the outsole via adhesive, stitching or other conventional methods. The midsole may be formed of conventional midsole materials, for example, polymer foam material such as polyurethane or ethylvinylacetate, which compresses to attenuate ground reaction forces during walking, running, or other ambulatory activities. In some embodiments of the article of footwear disclosed herein, the polymer foam material of the midsole may encapsulate or include various midsole elements, such as a fluid-filled bladder or moderator, which enhances the comfort, motion-control qualities, stability, or ground reaction force attenuation of the article of footwear.

Optionally, the sole structure may include an outsole formed as a cupsole and joined directly to an upper of an article of footwear. In this example configuration, the outsole provides the desired cushioning, flexibility and traction without the need for a midsole.

Even further, the outsole may be joined, for example, to a board-lasted or to a strobel-lasted construction. In a strobel-lasted construction a sole-shaped fabric material is stitched to the upper of the shoe, usually with stitches around the perimeter of the sole-shaped fabric. The lasted construction may include thin flexible materials, thicker and/or stiffer materials, compressible materials or a combination thereof to improve stability, flexibility and/or comfort. For example, the strobel-last may use a cloth material, such as a woven or non-woven cloth supplied by Texon International, or a newer variation, such as a thin sheet of EVA foam for a more cushioned feel. Further, the upper may be joined to a fiberboard (or EVA foam sheet) in one part of the shoe, while the other part is slip-lasted or strobel-lasted. As another non-limiting example, the lasting member may be formed as a bladder, i.e., a flexible gas-, fluid- or gel-filled chamber or plurality of chambers or compartments. This type of lasting member may provide a highly resilient cushioned feel.

The article of footwear may also include a sockliner, which is generally a thin, compressible member that is located within the void in the upper and adjacent to a lower surface of the wearer's foot to enhance the comfort of the wearer.

According to aspects of the disclosure, the outsole has at least one rib that projects upwardly from the top, interior surface of the ground-contacting layer. The rib projects a height above the interior surface of the ground-contacting layer. Further, the rib has a width and a length that are generally perpendicular to the height. The length of the rib is significantly greater than the height or the width of the rib, such that the rib forms a generally elongated structure extending over a portion of the interior surface of the outsole.

The desired dimensions of the ribs may depend upon the particular application of the article of footwear. Further, the dimensions of the ribs may depend upon the degree of impact-attenuation desired, the degree of flexibility desired, the locations of the ribs under the foot, the existence and/or spacing of adjacent ribs, the material used to form the ribs, etc. By way of non-limiting examples, in certain embodiments, the height of the rib may be greater than approximately 4 mm, or approximately 6 mm, or approximately 10 mm, or even approximately 15 mm. In other embodiments, the height of at least a portion of the rib may range from approximately 4 mm to approximately 10 mm, or from approximately 5 mm to approximately 9 mm, or even from approximately 6 mm to approximately 12 mm. In some embodiments, the height of the rib may depend upon its location in the outsole. Thus, by way of other non-limiting examples, the height of the rib in the heel region may be greater than the height of the rib in the forefoot region. In certain other embodiments, the width of the rib (when measured at the top of the rib) may range from approximately 2 mm to approximately 10 mm, preferable from approximately 3 mm to approximately 8 mm, and more preferably from approximately 4 mm to approximately 6 mm. The height-to-width ratio of the rib may be greater than 2, greater than 4, greater than 6, or even greater than 8.

According to certain aspects, the elongate axis of the rib may extend in a substantially longitudinal direction, i.e., the rib may extend in a direction parallel to the longitudinal axis or the rib may extend lengthwise between the back edge and the front edge, such that it generally extends longitudinally. In other words, the elongate axis rib may deviate from being parallel to the longitudinal axis, while still extending in a generally longitudinal direction. In one aspect, a rib extends in a substantially longitudinal direction if it extends farther in the longitudinal direction than it extends in the transverse direction. The rib may be straight or curvilinear. Further, the rib need not be of any particular length or provided in any particular location. Thus, by way of non-limiting examples, the rib may extend generally longitudinally over at least part of the length of the forefoot region, over at least part of the length of the combined forefoot and midfoot regions, over at least part of the length of the heel region or even over at least part of the length of the entire outsole from the front edge to the back edge.

According to other aspects, the rib may extend in a direction substantially transverse to the longitudinal direction. In other words, the rib may extend from a medial side of the outsole toward a lateral side of the outsole (or vice versa). The transversely extending rib may extend across the longitudinal axis. In some aspects, the rib may extend completely across the width of the outsole, from the medial edge to the lateral edge. As with the substantially longitudinally extending rib, the substantially transversely extending rib may be straight or curvilinear. In the most general of embodiments, the rib may extend in any direction, even extending in multiple directions as would a rib formed as a circle or a spiral, for example.

Even further, the outsole may be provided with a plurality of ribs. The plurality of ribs may include a plurality of substantially longitudinally extending ribs and/or a plurality of substantially transversely extending ribs. In certain embodiments, the plurality of ribs may cross over one another, forming a network of ribs.

During use, the one or more ribs may provide a support for the wearer's foot, i.e., the ribs may carry or react at least some of the vertical, compressive load transmitted from the wearer to the ground. Thus, according to certain aspects of the disclosure, the rib may be designed to elastically react vertical compressive loads. For example, the thickness of the side walls of the ribs may be relatively thick and the height of the ribs may be relatively shallow. In such case, the ribs may be designed to carry compressive loads without buckling, i.e., without exhibiting elastic instability and relatively large increases in vertical elastic deflection due to a corresponding relatively small increase in compressive load. In other embodiments, the side walls may be thinner and/or the height of the ribs may be taller, such that the ribs are designed to elastically buckle or bow under the expected compressive loads. According to certain aspects, the rib may be designed to compress under impact loads, thereby acting as a shock absorber and mitigating these impact loads. Very stiff ribs would compress very little, thereby providing very little cushioning effect. Less stiff ribs would compress more, such that impact loads would be attenuated. The stiffness and compression characteristics of any particular rib is a function not only of its geometry, but also of its material properties.

In certain aspects, the rib may have an essentially linear stiffness profile over the deflection range of interest, i.e., the compressive deflection of the rib in the vertical direction may increase linearly as the compressive load is applied. In certain other aspects, the rib may have a smoothly curved, non-linear stiffness profile. For example, the amount of compressive deflection of the rib may gradually decrease as the compressive load is applied in the deflection range of interest. This may be the case if, for example, the cross-section of the rib decreases proportionally to its increase in height above the ground-contacting layer of the outsole.

In even other aspects, the stiffness profile of the rib in the vertical direction may encompass a first stage, wherein the rib is relatively soft and the amount of vertical deflection for a given vertical load is relatively high, and a second stage, wherein the rib is relatively stiff and the amount of vertical deflection for a given vertical load is relatively low. This may be achieved, for example, by reacting the initial vertical compressive loads with a relatively soft, easily compressed portion of the rib and then, when this soft portion is fully (or substantially fully) compressed, reacting the subsequent vertical compressive loads with a relatively stiff portion of the rib. Such a multi-stage or multi-zoned vertical stiffness profile may allow impact loading associated with normal activities such as walking to be reacted by the softer portion of the rib, thereby providing a "comfort zone" of operation. The greater impact loading associated with jumping and tricks may be mostly reacted by the stiffer portion of the rib, thereby providing a "high-performance zone of operation," i.e., a stiffness regime that provides superior protection for the wearer during such high impact activities.

In some aspects, the multi-stage or multi-zone stiffness profile of the rib may be achieved by the structural dimensions of the ribs. In certain embodiments, a first portion of the rib located adjacent the ground-contacting layer may have a cross-sectional area that is greater than a second portion of the rib located above the first portion In some aspects, the multi-zone stiffness profile may be achieved by varying the material properties of the rib. For example, the rib may be formed of a relatively hard durometer rubber close to the ground-contacting layer, while the top portion of the rib may be formed from a foamed elastomer. Optionally, both the geometry and the material of the rib may be chosen to provide the desired multi-zone stiffness characteristics. Further, the multi-zone stiffness profile may encompass more than two stages.

Even further, according to certain aspects, the vertical compressive stiffness profile of the rib may vary along the length of the rib. Thus, for example, a rib that extends substantially longitudinally from the back edge to the front edge may have a softer first portion (i.e., the high-performance zone) in the heel region than in the forefoot region of the article of footwear, while having the same comfort zone characteristics along the entire length of the rib. Further, the rib may have only a single stiffness characteristic zone in the midfoot region, a two-stage zone in the forefoot region and a three-stage zone in the heel region. When the outsole includes a plurality of ribs, any of the ribs may have any of the various stiffness profiles discussed above.

According to certain aspects of this disclosure, the rib is a freestanding structure. The term "freestanding" means that the rib projects upwardly from the top surface of the ground-contacting layer with a majority of its side wall area being unsupported, i.e., not in contact with any adjacent material or structure. In other words, for a freestanding rib there is no material, such as polymeric foam or rubber-type insert, contacting and stabilizing a majority of the side wall area of the rib. Further, the side walls of a freestanding rib are not supported by any fluid, as would be the case if the ribs were part of a bladder-like structure. Although, a rib may be locally in contact with other material or structure where it intersects other ribs or at its ends, in the context of this disclosure, such a rib is still considered "freestanding" if the support from the intersecting ribs is localized and does not result in a majority of the side wall area of the rib being supported. In certain embodiments, greater than 50% of the side wall area of the rib may be unsupported. In other embodiments, greater than 60%, or greater than 70%, or greater than 80% or even of 90% of the side wall area of the rib may be unsupported. Thus, in the vicinity of a freestanding rib, the rib alone carries any compressive loads that are transmitted from the wearer to the ground (or vice versa). This allows the compressive loads to be concentrated where the rib is located. In certain embodiments, the rib may be capable of carrying these concentrated compressive loads without buckling.

Alternatively, according to certain aspects of this disclosure, one or more intercostal elements, such as polymeric foam inserts, rubber-type inserts or air bladders, may be provided. These intercostal elements may contact and/or stabilize the ribs or portions of the ribs. For example, a majority of the side wall area of the rib may be in contact with a relatively stiff, compressible, foam. As another example, only the lower portion of the side wall of the rib, i.e., the portion of the side wall adjacent to the ground-contacting layer may be in contact with a supporting material. Providing intercostal elements may allow the compressive loads to be concentrated where the ribs are located, while at the same time, stabilizing the side walls of the ribs such that buckling does not occur.

Optionally, intercostal elements may be provided between the ribs and/or between the ribs and the edge of the outsole without necessarily contacting the ribs or the edge. According to certain configurations, one or more intercostal elements may extend from the ground-contact surface to (or adjacent to) the top of the outsole, such that they provide additional load paths, additional cushioning or additional impact-attenuation capabilities to the outsole. By way of non-limiting example, the intercostal elements may be provided as inserts attached to the upper surface of the ground-contacting layer. As another example, the intercostal elements may be integrally molded or co-molded with the outsole. These intercostal elements may be formed as blocks, posts, frames or hat-like structures, bladders, etc. from any suitable material.

Even further, the outsole may be provided with an upper layer that is sealed either to the perimeter of the outsole, to the tops of the ribs, and/or to both. The upper layer may be part of a last, a midsole structure, or it may be provided as a separate element. The upper layer need not extend completely over the outsole, but may be located in one or more regions of the outsole. For example, the upper layer may be located in the heel region and/or in the forefoot region, but not in the midfoot region. The upper layer-to-outsole seal forms a fluid-tight seal that defines one or more fluid-tight chambers. The fluid-tight chambers may accommodate and retain air (or other gas, positively pressurized or not) or a fluid (for example, water, positively pressurized or not). Thus, in essence, an outsole with a sealed upper layer forms at least one interior chamber that may function as a fluid bladder and thereby assist in carrying and distributing loads.

According to another aspect, the top surface of the ground-contacting layer that lies adjacent to the ribs does not carry compressive loads transmitted from the wearer to the ground (or vice versa). Thus, again, in the vicinity of the rib, only the rib carries or reacts these loads. By way of non-limiting example, the top surface of the ground-contacting layer located between ribs may be a free surface, i.e., a surface that is not in contact with other materials.

As disclosed above, according to certain aspects, the sole structure may include both an outsole and a midsole. The midsole may rest on (or be secured or attached to) the uppermost surface of the rib, such that the rib transmits compressive loads from the midsole to the ground-contacting layer.

In accordance with aspects of the disclosure, the outsole of the article of footwear has a rib with a channel or trough formed therein. The channel provides greater flexing of the outsole for a given load. For example, the channel may allow the outsole to flex such that one portion of the outsole may act relatively independently, or quasi-independently, of another portion. The flexibility provided by the channel may allow a user such as a skateboarder to keep a larger percentage of the outsole on the board for a longer time period, thus maintaining good contact with the board as the skateboarder transitions from one position to another. Such "independent" action of portions of the outsole may allow the wearer of the footwear to better control the application of pressure over the sole area.

According to aspects of the disclosure, the rib includes side walls and an end wall defining a channel or a trough. The channel has a depth, a width and a length. The depth of the channel is generally aligned with the height direction of the rib. The width of the channel is generally aligned with the width direction of the rib. The length of the channel is generally aligned with the length direction of the rib. The opening of the channel is directed downward, such that the channel opens through the ground-contacting layer. The depth of the channel extends from the opening of the channel to the second end of the channel. In certain aspects, the depth of the channel extends from the opening of the channel at the ground-contacting surface to the end surface of the channel. This depth is greater than the thickness of the ground-contacting layer. Thus, at least a portion of the channel extends above the top surface of the ground-contacting layer. In general, the greater the depth of the channel, the greater the flexibility of the outsole.

The channel is defined by side walls of the rib. The channel may also be defined by an end wall of the rib. In general, the side walls and/or the end wall are continuous. Optionally, the side walls and/or the end wall may be discontinuous. For example, a rib may have continuous side walls and a discontinuous end wall, such that the channel defined therebetween is a close-ended channel in some portions (i.e., the end wall extends from the first side wall to the second side wall in these close-ended portions, such that the channel is open at the ground-contacting surface and closed at the end wall surface) and is an open-ended channel in other portions (i.e., there is a gap in the end wall, such that the channel is open at both of its top and bottom ends). In some embodiments, the end surface of the channel may be formed by a midsole or other structure that engages the top of the rib.

The channel may have a constant width along the depth direction and/or a constant width along the length direction. Alternatively, the width of the channel may vary along the depth direction or along the length direction or both. For example, the channel may be wider at the opening at the ground-contacting surface and narrower at the end wall surface. Similarly, the depth of the channel may vary along the length direction of the rib. Thus, as a non-limiting example, the height of a rib could be constant along its length, while the depth of the channel varies along the length. The flexibility of the outsole could thus, at least partly, be controlled by controlling the relative depth of the channel.

The desired dimensions of the channels may depend upon the particular application of the article of footwear. Further, the dimensions of the channels may depend upon the degree of impact-attenuation desired, the degree of flexibility desired, the locations of the channels under the foot, the existence and/or spacing of adjacent channels, the material used to form the channels, etc. By way of non-limiting examples, in certain embodiments, the depth of the channel may be greater than approximately 5 mm, greater than approximately 6 mm, greater than approximately 10 mm, or even greater than approximately 15 mm. In other embodiments, the depth of at least a portion of the channel may range from approximately 4 mm to approximately 10 mm, or from approximately 5 mm to approximately 9 mm. or even from approximately 6 mm to approximately 12 mm. In some embodiments, the depth of the channel may vary depending upon its location in the outsole. Thus, by way of other non-limiting examples, the depth of the channel in the heel region may be greater than the depth of the channel in the forefoot region. In certain other embodiments, the width of the channel (when measured at the opening of the channel) may range from approximately 0.5 mm to approximately 8 mm, preferable from approximately 1 mm to approximately 6 mm, and more preferably from approximately 2 mm to approximately 4 mm. The depth-to-width ratio of the channel may be greater than 2, greater than 4, greater than 6, or even greater than 8.

Further, the thickness of the side walls of the channel may be constant. Alternatively, the thickness of the side walls need not be constant, either in the height direction of the rib or in the length direction of the rib. By way of non-limiting example, the side walls may be thicker at the bottom (i.e., near the ground-contacting layer) and thinner at the top of the rib. The thickness of the side walls, at least partly, will affect the vertical compressive stiffness of the rib. Further, the height of the side walls will also affect the vertical compressive stiffness of the rib. Short and wide side walls will provide greater compressive stiffness than will relatively tall, thin side walls.

Even further, the thickness of the end wall of the rib may be constant or it may vary. By way of non-limiting example, the end wall may be thicker near the side walls than at the centerline of the rib. As another non-limiting example, the thickness of an end wall of a rib extending longitudinally from the back edge to the front edge of the article of footwear may be thicker in the heel region and thinner in the forefoot region. In some aspects, the end wall may function as a hinge, wherein a portion of the outsole flexes relative to another portion due to bending of the hinge formed by the end wall.

In some aspects, the vertical placement of the end wall of the rib may be at the upper ends of the side walls. In certain other aspects, the end wall may be placed lower down. The vertical placement of the end wall may be used to develop a particular stiffness profile of the rib. For example, a rib with an end wall placed lower down may have a softer initial stiffness and a greater secondary stiffness, than the same rib with the end wall placed higher up. Even further, the vertical placement of the end wall may be use to achieve varying multi-zone stiffness properties along the length of the rib. For example, the height of a rib may be maintained at a constant height, but the vertical placement of the end wall of the rib may be varied along the length of the rib (i.e., raised or lowered), thereby creating multi-zone stiffness properties that varying along the length of the rib. This embodiment also illustrates that the stiffness profiles of the ribs may not only vary from one rib to another, but also that the stiffness profiles may vary along the length of any given rib.

The desired dimensions of the channels, the side walls, and the end walls may also depend upon the particular application of the article of footwear. Thus, for example, the dimensions of the depths of the channels, the thicknesses of the side walls and/or the thicknesses of the end walls may be selected depending upon the degree of impact-attenuation or the degree of flexibility desired. Further, the degree of impact-attenuation and/or the degree of flexibility may be influenced by the placement of the channels under certain areas of the foot and/or the existence or spacing of adjacent channels. Even further, the degree of impact-attenuation and/or the degree of flexibility may be influenced by the material used to form the side walls and end walls. By way of non-limiting examples, in certain embodiments, the thickness of the side walls and/or the end walls may be greater than approximately 0.5 mm, greater than approximately 1 mm, greater than approximately 2 mm, or even greater than approximately 3 mm or even 4 mm. In some embodiments, the thickness of the walls may depend upon their location in the outsole. Thus, by way of other non-limiting examples, the thickness of the side walls in the heel region may be greater than the thickness of the side walls in the forefoot region. In certain other embodiments, the thickness of the end walls in the heel region may be greater than the thickness of the end walls in the forefoot region.

According to certain aspects, the cross-section of the rib need not be symmetric. For example, one of the side walls may be thicker than the other side wall. This non-symmetry may result in non-symmetric flexure of the outsole or portions of the outsole, such that flexural characteristics of the article of footwear may be tailored to the particular application.

As describe above, the dimensions of the ribs, the channels and the walls defining the channels affect the stiffness and flexibility characteristics of the outsole. For example, when a minimum thickness of the end wall defining the channel is less than a minimum thickness of the side walls defining the channel, the rib may likely flex at the end wall. Thus, the dimension of the end wall and the depth of the channel may strongly affect the flexing characteristics of the outsole. As another example, when the side walls are relatively thick the rib may be capable of reacting significant compressive loads.

According to certain other aspects, the outsole may be provided with a plurality of ribs and a least some of the ribs may define channels. A channel need not be formed in every rib. Nor need the channels extend lengthwise along the entire length of any one rib. In certain embodiments, a plurality of ribs having channels may cross over one another, forming a network of channels. Where the ribs cross over one another and intersect, the channels may extend across the intersection such that the channels are continuous for both ribs. Alternatively, where the ribs intersect, the channel of one of the intersecting ribs may extend across the intersection and the channel of the other intersecting rib may be blocked off at the intersection, such that the channel does not extend across the intersection. As another non-limiting example, the intersection of the ribs may form a post or column, wherein neither of the channels of the intersecting ribs extend through the intersection.

As disclosed, the ground-contacting layer may thus be divided into portions by the channels extending therethrough. Thus, the ground-contacting layer need not be continuous, but may be formed, in the aggregate, from a plurality of these ground-contacting portions. These ground-contacting portions may move relative to one another in a quasi-independent manner. In accordance with even other aspects of the disclosure, the distance between adjacent ribs is greater than the width of the ribs. In other words, the ribs are relatively widely spaced, such that the compressive loads transmitted by the ribs may be experienced by the perimeter portion of the individual ground-contacting portions residing between the channels, while the central portion of the individual ground-contacting portions may be substantially unloaded. In certain embodiments, the amount of ground-contacting surface is significantly greater than the surface area covered by the ribs.

A network of intersecting channels may enhance the ability of the outsole to flex. For example, the enhanced flexibility of the outsole may result in a "cupping action," i.e., a portion of the sole structure pulls away from the ground surface when pressure is applied adjacent the edges of the sole structure. This "cupping action" releases some of the pressure in the central portion of the sole structure and increases the pressure and gripping action near the edges of the sole structure.

Thus it can be seen that the enhanced flexibility due to the channels allows a wearer of the footwear to develop more specific control of the loads applied to the surface. For a skateboarder, this results in improved traction and control of the skateboard. By providing an article of footwear with an outsole having ribs for reacting vertical compression loads and channels for providing flexibility and quasi-independent movement of the portions of the outsole, an article of footwear having superior dynamic and control-enhancing characteristics is achieved.

II. Detailed Description of Example Embodiments

Figure 2:
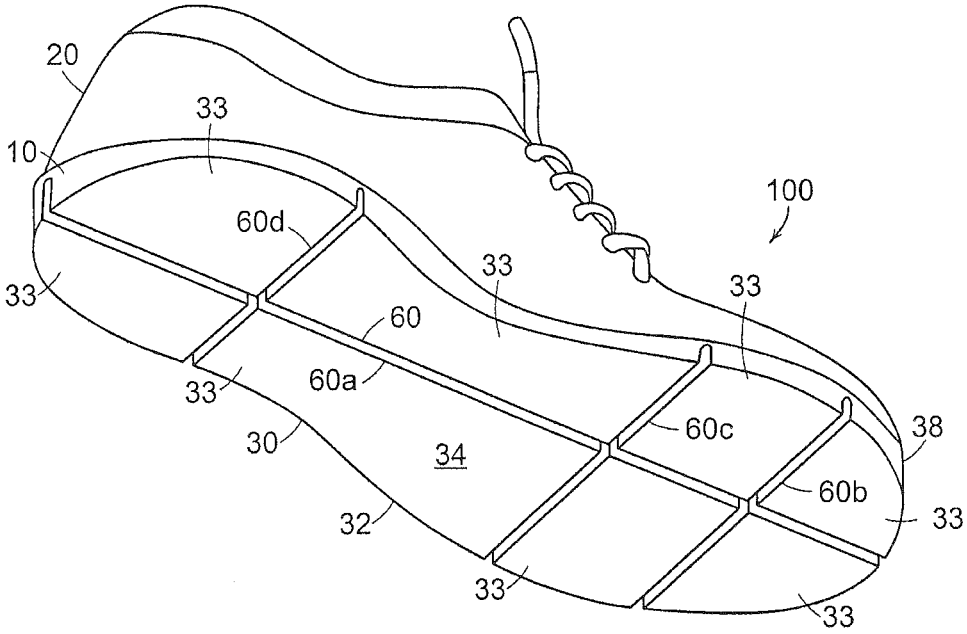
FIG. 2 is a perspective view, looking from the bottom, of the article of footwear shown in FIG. 1.

An article of footwear 100 is depicted in FIGS. 1-2 as including a sole structure 10 and an upper 20. Upper 20 is secured to sole structure 10 and defines a void for receiving a foot.

Figure 3:
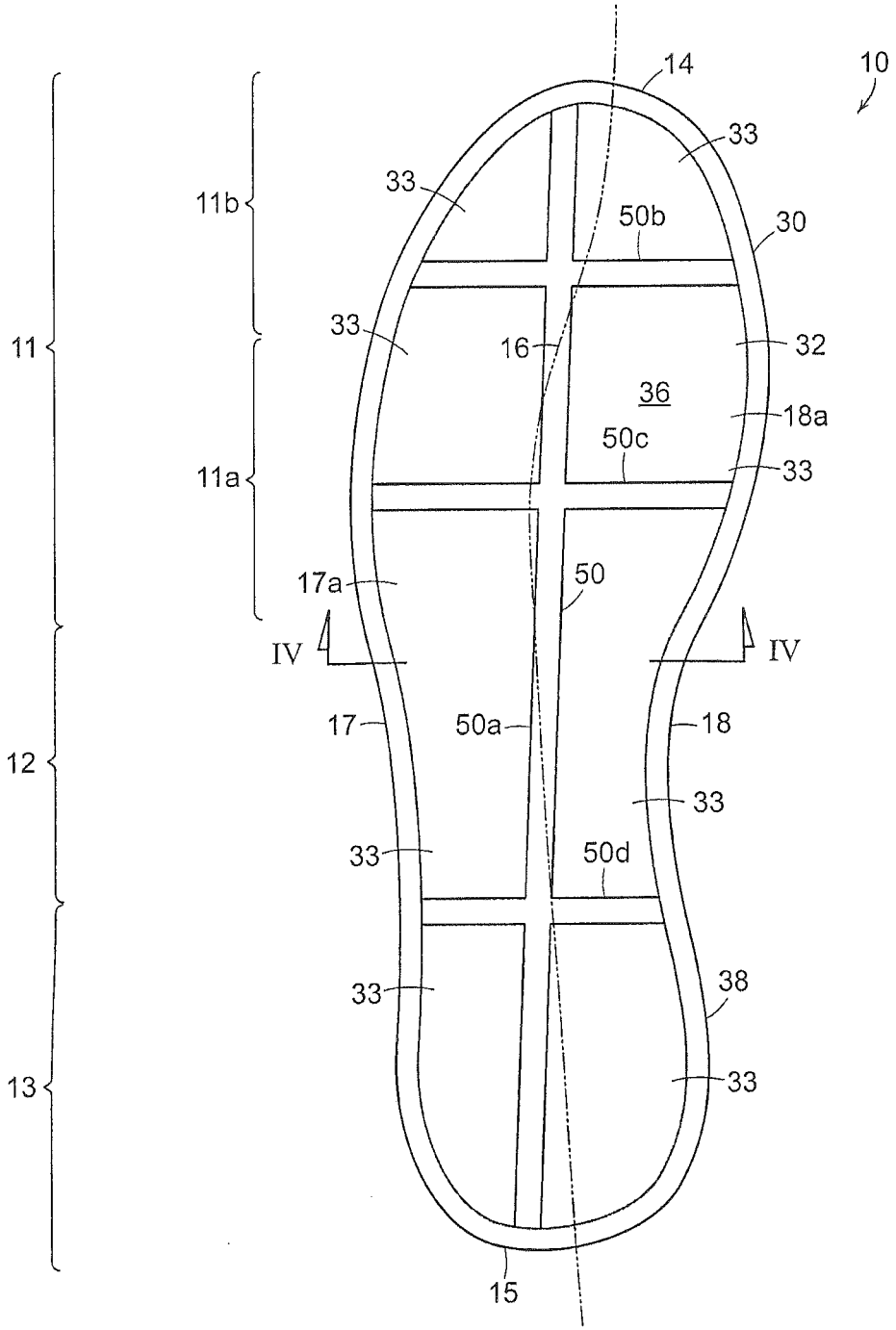
FIG. 3 is a view of the interior surface of the outsole of the article of footwear shown in FIG. 1, taken along line III-III of the article of footwear shown in FIG. 1.

Referring to FIG. 3, sole structure 10 may be divided into three general regions: a forefoot region 11, a midfoot region 12, and a heel region 13. These three regions extend between a front edge 14 and a back edge 15. Forefoot region 11 may further be considered to encompass a ball portion 11*a* and a toe portion 11*b*. Ball portion 11*a* generally extends under the ball region of the foot. Toe portion 11*b* generally extends under the toe region of the foot. Although regions 11-13 apply generally to sole structure 10, references to regions 11-13 may also apply to article of footwear 100, upper 20, or an individual component within either sole structure 10 or upper 20.

Sole structure 10 defines a longitudinal centerline 16. Longitudinal centerline 16 extends from front edge 14 to back edge 15 and generally bisects sole structure 10. A medial edge 17 and a lateral edge 18 extend from front edge 14 to back edge 15 along the medial and lateral sides of sole structure 10, respectively. Additionally, longitudinal centerline 16 defines a medial side 17*a* and a lateral side 18*a*.

Referring back to FIG. 1, upper 20 may include an ankle opening that provides the foot with access to the void within upper 20. As is conventional, upper 20 may also include a vamp area having a throat and a closure mechanism, such as laces 25.

Sole structure 10 is secured to a lower surface of upper 20 and has a structure that includes an outsole 30. In one aspect, the sole is a cup sole, formed as a single piece.

Figure 4A:
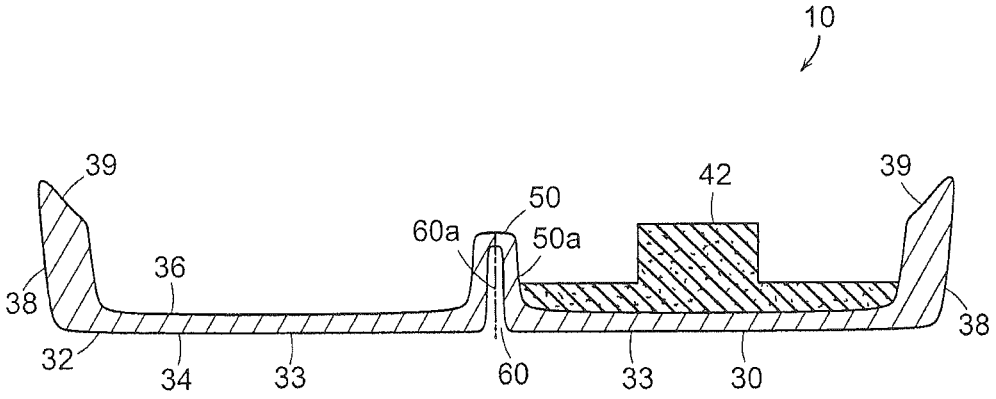
FIG. 4A is cross section, taken along line IV-IV of FIG. 3, of the sole structure of the article of footwear shown in FIG. 1.

As seen in FIGS. 2, 3 and 4A, outsole 30 includes ground-contacting layer 32. Ground-contacting layer 32 includes a ground-contacting surface 34 (see FIGS. 2 and 4A) and a top surface 36 (see FIGS. 3 and 4A). Ground-contacting layer 32 is a generally planar layer, in that ground-contacting layer 32 has width and length dimensions significantly greater than a thickness dimension. A generally planar layer may have a slight curvature or other slight deviations from the perfectly planar. As is apparent from the disclosure, ground-contacting layer 32 need not be continuous, but may be formed, in the aggregate, from a plurality of ground-contacting portions 33. Ground-contacting portions 33 may move relative to one another in a quasi-independent manner. Further, ground-contacting layer 32 may be formed of one or more materials integrally secured to one another. For example, ground-contacting layer 32 may be formed of multiple plies of materials that are co-molded to one another. As another example, ground-contacting layer 32 may be formed from a molded layer with a coating applied post-molding. The coating could be sprayed, painted, dipped or otherwise deposited on the molded layer. Optionally, the coating could be applied as a film or a laminate.

Referring to FIGS. 3 and 4A, outsole 30 further includes a plurality of ribs 50. Ribs 50 are relatively narrow, elongated features that project above the top surface 36 of the ground-contacting layer 32 and extend along the top surface 36 of outsole 30. Outsole 30 further includes a rim 38 that projects upward from the ground-contacting layer 32 and that extends around the perimeter of outsole 30. Rim 38 may engage and support upper 20 at an upper surface 39.

Figure 4B:
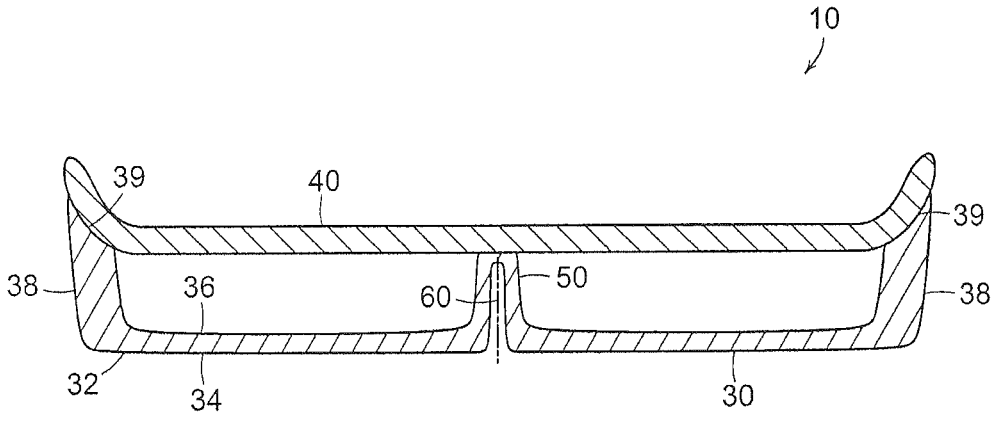
FIG. 4B is a cross section of a configuration of the sole structure of the article of footwear in accordance with an alternative embodiment.

According to other aspects of the disclosure, an upper layer may be joined to outsole 30. By way of non-limiting examples, outsole 30 may be joined in any suitable fashion to a strobel material, a board-type last, a midsole, etc. Thus, as shown in FIG. 4B, sole structure 10 may include an upper layer provided as a midsole 40. Midsole 40 is positioned above outsole 30 where it may be attached to upper surfaces 39 of rim 38 by any suitable method. Midsole 40 may be formed from any suitable materials or assembly of materials, as are known in the art. Typically, midsoles are less stiff than outsoles, thereby increasing the shock-absorbing and impact-attenuation properties of the sole structure 10. As shown in FIG. 4B, midsole 40 may be connected to the top surface of rib 50, such that the compressive weight of the wearer is transmitted from the midsole 40 to the rib 50. By way of non-limiting examples, the connection between the midsole 40 and the ribs 50 of the outsole 30 may be due to a permanent engagement, such as via an adhesive bond, or due to a surface-to-surface non-bonded contact. Further, the engagement of midsole 40 to outsole 30 may include a fluid-tight sealing engagement, such that air (or other gas) or water (or other liquid) may be sealed within one or more of the chambers formed by the engagement of midsole 40 to outsole 30. In certain instances, the fluid (air, water, etc.) may be pressured.

According to even other aspects of the disclosed structure, one or more intercostal elements may be provided. Referring back to FIG. 4A intercostal elements 42, such as an polymeric foam insert (shown), a rubber-type insert, or an air bladder, may be located between adjacent ribs 50 or between ribs 50 and rim 38. Intercostal elements 42 may completely fill or only partially fill the volume defined by ribs 50 and/or rim 38.

As best shown in FIG. 3, rib 50*a* extends in a generally longitudinal direction from the back edge 15 to the front edge 14. Ribs 50*b*-50*d* extend in a generally transverse direction to the longitudinal axis 16 from medial edge 18 to lateral edge 17. Rib 50*b* is located in the toe portion 11*b* of forefoot region 11. Rib 50*c* is located in the ball portion 11*a*. Rib 50*d* is located in the heel region 13. As illustrated in FIGS. 1-5, in this particular embodiment, ribs 50*a*-50*d* are straight and cross over one another at right angles.

Figure 5:
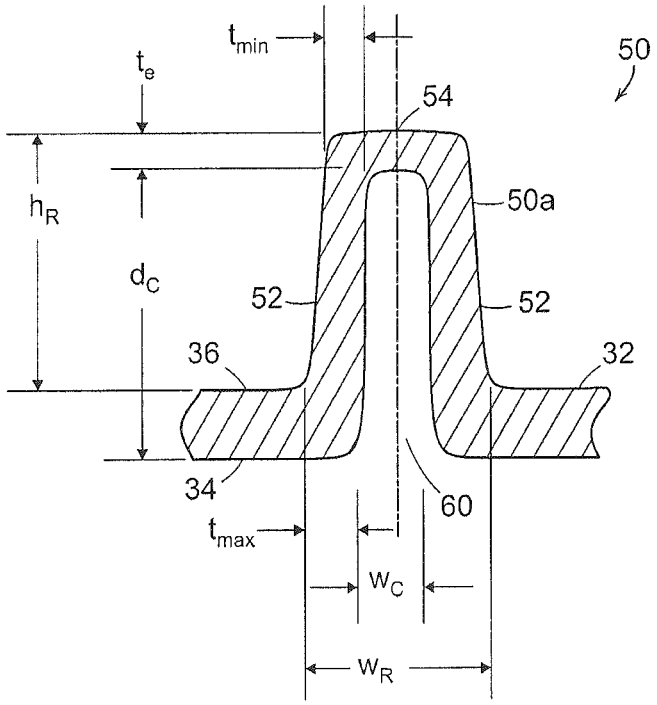
FIG. 5 is a detailed cross-sectional view of the rib and channel shown in the cross section of the outsole shown in FIG. 4A.

As illustrated in FIGS. 2, 4A and 5, rib 50 includes a channel 60. Specifically, channel 60*a* is associated with rib 50*a*; channel 60*b* is associated with rib 50*b*, channel 60*c* is associated with rib 50*c*, and channel 60*d* is associated with rib 60*d*. The channels 60 increase the flexibility of the outsole 30, and thus, increase the flexibility of the entire sole structure 10. In this particular embodiment, each rib 50 has a channel 60 that extends the full length of the rib 50. Further, in this particular embodiment, as best seen in FIG. 2, channel 60*a* is continuous across the intersections of channels 60*b*-60*d*, while channels 60*b*-60*d* are discontinuous at their respective intersections with channel 60*a*. In other words, where transverse channels 60*b*-60*d* intersect longitudinal channel 60*a*, the side walls forming channel 60*a* extend across and block the transverse channels 60*b*-60*d*.

As best shown in FIG. 5, rib 50 defines a rib height ($h_R$) and a maximum rib width ($w_R$). The height of the rib is measured as the distance above the top surface 36 of the ground-contacting layer 32 to the top of rib 50. In this particular embodiment, rib 50 has a maximum width at its base adjacent to the ground-contacting layer 32 and slightly tapers as it extends upward. Further, rib 50 has a height-to-width ratio of approximately 1.5. In general, rib 50 may assume other shapes and need not have any particular aspect ratio. By way of a non-limiting example, the rib height-to-width ratio may be greater than or equal to 1.0. Optionally, rib height-to-width ratios may range from approximately 1.0 to approximately 3.0, from approximately 1.0 to approximately 5.0, from approximately 2.0 to approximately 5.0, or even greater than 5.0. Even further, for certain embodiments, the rib height-to-width ratio may be less than 1.0 for relatively wide shallow ribs.

Channel 60 has a channel depth ($d_C$) that is substantially aligned with the height direction of the rib 50 and a maximum channel width ($w_C$) that is substantially aligned with the width direction of the rib 50. Channel 60 has an opening through the ground-contacting layer 32 and through the ground-contacting surface 34. The depth of the channel 60 is measured from the ground-contacting surface 34 to the end surface of the end wall 54. In this particular embodiment, channel 60 has a constant width and a depth-to-width ratio of approximately 4.5. However, in general, channel 60 may assume other shapes and need not have any particular aspect ratio. By way of a non-limiting example, the channel depth-to-width ratio may be greater than or equal to 1.0. Optionally, channel depth-to-width ratios may range from approximately 1.0 to approximately 3.0, from approximately 1.0 to approximately 5.0, from approximately 2.0 to approximately 5.0, or even greater than 5.0. Even further, for certain embodiments, the channel depth-to-width ratio may be less than 1.0 for relatively wide shallow channels.

According to aspects of this disclosure, the channel depth ($d_C$) is greater than 100% of the thickness of the ground-contacting layer 32 of outsole 30. This means that the channel extends from the ground-contacting surface 34 to up above, (i.e., beyond) the top surface 36 of the ground-contacting layer 32 and into the rib 50. In other words, at least a portion of the channel 60 is defined within the rib 50. Generally, the greater the channel depth, the more flexible the outsole 30. In certain embodiments, the depth of the channel could be greater than 110% of the thickness of the ground-contacting layer 32, greater than 120%, greater than 150%, and even greater than 200% or even 300%. Moreover, as noted above, any given channel 60 need not have a constant depth along its entire length. As a non-limiting example, varying the channel depth $d_C$ may be accomplished by varying the vertical placement of the end wall 54 (either higher or lower) while maintaining the rib 50 at a constant rib height $h_R$.

Because of the flexing of the outsole 30, it may be desirable to control the width ($w_C$) of the channel 60 in the outsole 30 to within a certain range. If the width is too small, it would interfere with the flexing action (i.e., the edges of the channel 60 might bear against one another). If, on the other hand, the width is too large, the channel 60 might catch on the edges of a skateboard, for example, or on other ground edges as the foot moves and slides. In such case, the width of the channel is preferably designed to prevent or minimize interference between the two sides of the channel 60 during the flexing action and also to prevent or minimize the edges of the channel 60 from catching on the skateboard or other surfaces. According to other aspects, the width of the channel may be influenced by manufacturing or durability concerns, in that a smaller width may provide more durability, while a larger width may be desirable from a manufacturing standpoint. In one embodiment, the channel width ($w_C$) is approximately 7 mm. In other embodiments, the width of the channel could range from approximately 4 mm to approximately 10 mm, preferably from slot 4 mm to approximately 8 mm, and more preferably from approximately 6 mm to approximately 7 mm. Further, any given channel 60 need not have a constant width ($w_C$) along its entire length.

Channel 60 is defined by side walls 52 of rib 50. Each side wall 52 has a maximum side wall thickness ($t_{max}$) and a minimum side wall thickness ($t_{min}$). In this particular embodiment, the side walls 52 are thickest adjacent to the ground-contacting layer 32 and thinnest adjacent to the end wall 54. Further, an end of channel 60 may be defined by end wall 54 of rib 50. End wall 54 has a minimum end wall thickness ($t_e$). In this particular embodiment, end wall 54 has a constant thickness. Furthermore, in this particular embodiment, the thickness ($t_e$) of the end wall 54 is less than the minimum thickness ($t_{min}$) of the side wall 52. This relative thickness of the end wall to the side wall may provide two advantages: the thinner end wall acts as the hinge around which the portions of the outsole 30 flex and the thicker side wall is sufficiently stiff to react the vertical compressive loads. Further, as illustrated in FIG. 5, in certain embodiments, rib 50 and channel 60 are symmetric with respect to a rib centerline.

Figure 6:
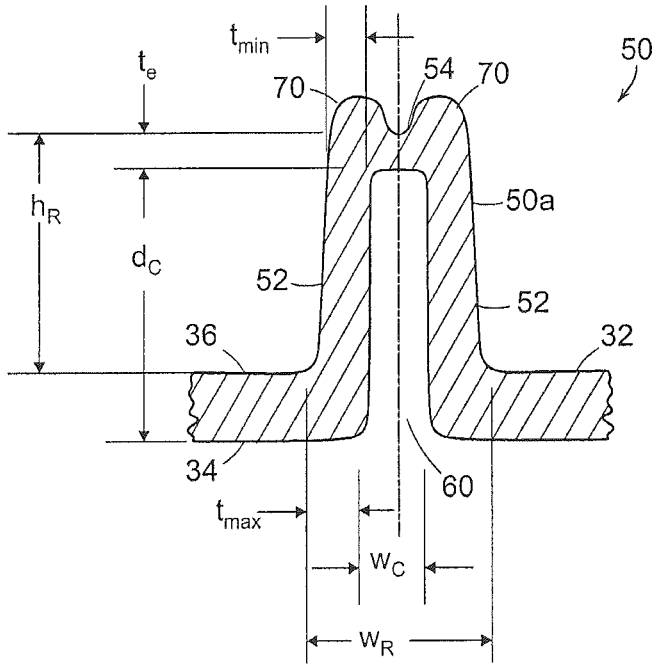
FIG. 6 is detailed cross-sectional view of an alternative rib and channel configuration in accordance with an alternative embodiment.

FIG. 6 illustrates an alternative embodiment of the rib 50 of FIG. 4A. As compared to the embodiment of FIG. 5, the rib 50 of FIG. 6 includes a pair of projections 70. Projections extend upwardly from side walls 52, beyond the top surface of end wall 54. In this particular embodiment, projections 70 form somewhat rounded bumps on the top of rib 50. In general, projection 70 may assume other shapes and need not have any particular aspect ratio. For example, projections 70 may be present along the entire length of rib 50 or they may be present only along a portion of the length of any given rib 50. Further, projections 70 may be formed as elongate elements having an elongated dimension generally aligned with the length of rib 50. The height of any such elongated projection 70 may increase or decrease as it extends along the length of the rib 50. Alternatively, projections 70 may be formed as compact, non-elongated elements. In such instance, the projections 70 may be arrayed as a series of individual elements, the array of elements extending along at least a portion of the length direction of the rib 50. Even further, the projections 70 need not be symmetric to one another. For example, a first projection 70 may extend upward more than a second projection 70. Thus, the first projection 70 may start to react compressive loads prior to the second, shorter projection 70 starting to carry such loads.

Figure 7A:
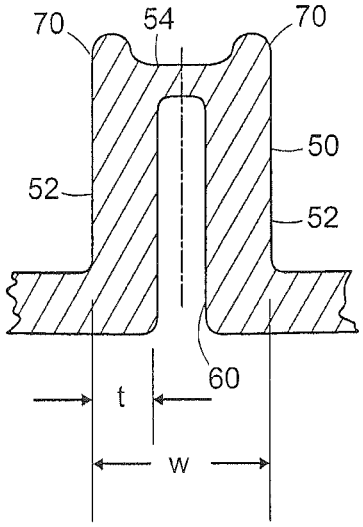
FIGS. 7A through 7G are detailed cross-sectional views of various alternative rib and channel configurations in accordance with alternative embodiments.

FIGS. 7A-7G illustrate several non-limiting examples of various configurations for rib 50, channel 60 and projection 70. Briefly, FIG. 7A illustrates that the rib 50 may have constant width (w) and that the side walls 52 may have a constant thickness (t).

Figure 7B:
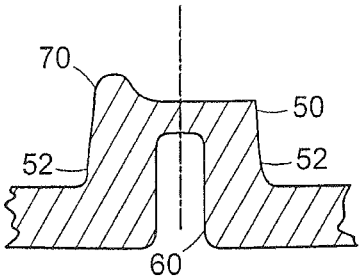

In FIG. 7B, rib 50 and channel 60 have aspect ratios (height-to-width and depth-to-width, respectively) less than the aspect ratios of the rib and channel of FIG. 6. In fact, in this particular embodiment, the aspect ratio of the rib 50 is less than one. Further, in FIG. 7B, a projection 70 is provided on a first side wall 52, but not on the other side wall. This may result in the first side wall 52 reacting more compressive loads than the other side wall 52. Further, in one embodiment, the projection 70 may be provided on only the first side wall 52 in a first region of the rib 50, but may be provided on only the other side wall 52 in another region of the rib 50. Such a "staggered" placement of projections on the rib 50 may allow a weight savings or a further tailoring of the shock absorbing characteristics of the outsole 30.

Figure 7C:
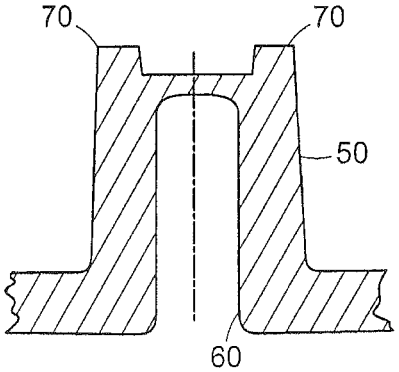

In FIG. 7C, the projections 70 are not rounded and the proportions of the rib 50 and channel 60 differ from that of FIG. 6 and from that of FIG. 7B.

Figure 7D:
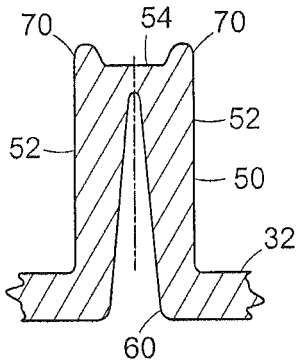

In FIG. 7D, the rib 50 has a constant width, but the width of the channel 60 decreases as it extends away from the ground-contacting layer 32. In this particular embodiment, the thickness of the side wall 52 increases as it extends upward from the ground-contacting layer 32, being a minimum at the lower end of the rib 50, i.e., closest to the ground-contacting layer 32, and a maximum at the upper end of the rib 50 close to the end wall 54.

Figure 7E:
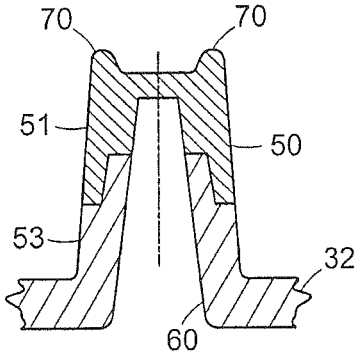

In FIG. 7E, the projections 70 and an upper portion 51 of rib 50 are formed of a different material than the ground-contacting layer 32 and a lower portion 53 of rib 50. As a non-limiting example, the upper portion 51 and the lower portion 53 of rib 50 may be co-molded to one another. Other conventional methods of attaching polymeric material to one another, as are known to person of ordinary skill in the art may be used to attach upper portion 51 to lower portion 53. The material of upper portion 51 may have a lower compressive modulus of elasticity than the material of lower portion 53, thus providing a relatively soft shock-absorbing portion of the rib 50.

Figure 7F:
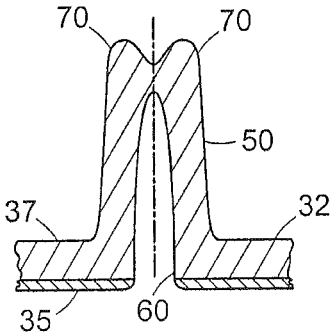

In FIG. 7F, the rib 50 tapers linearly as it projects upward from the ground-contacting layer, while the channel 60 curves inward as it extends upward. Further in FIG. 7F, the ground-contacting layer 32 is illustrated as being formed of more than one material. Specifically, the ground-contacting layer 32 includes an abrasion resistant layer 35 that has been co-molded, for example, to a pliable layer 37. Optionally, abrasion resistant material may be incorporated into the ground-contacting layer 32, for example, as a filler within the more pliable material of the outsole 30.

Figure 7G:
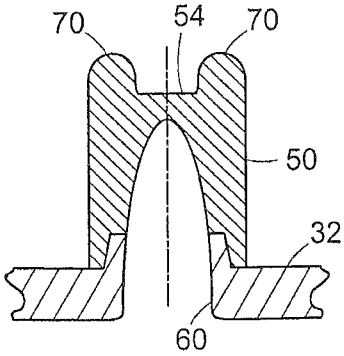

In FIG. 7G, the rib 50 has a constant width, while the channel 60 curves inward as it extends upward. The curvature of the channel 60 at its end surface results in an end wall 54 having a varying thickness. The end wall 54 has a thinnest cross-section at its midpoint. This "necking down" of the end wall 54 may concentrate the flexing of the outsole 30 to the necked-down region. Also, as shown in FIG. 7G, in this particular embodiment, the rib 50 is formed of a different material than the ground-contacting layer 32. Rib 50 may be co-molded, adhesively bonded, or otherwise attached to the ground-contacting layer 32 in any suitable manner as is known by persons of ordinary skill in the art.

Figure 8A:
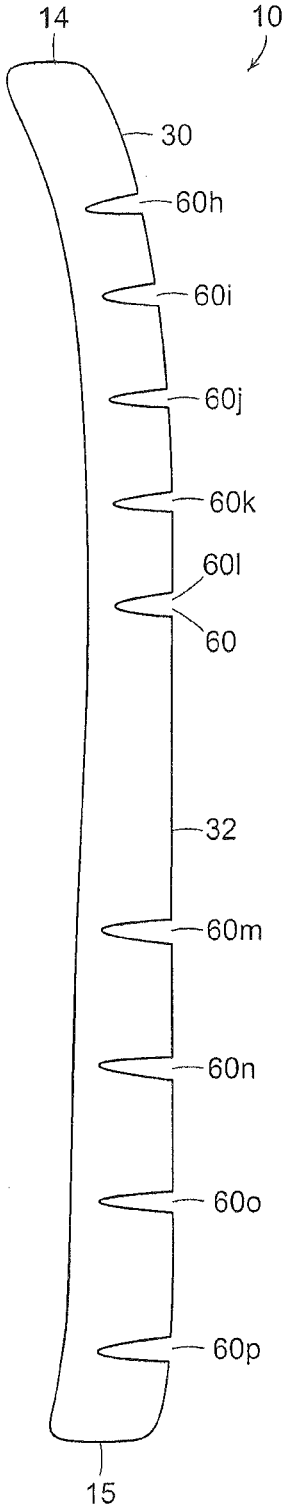
FIG. 8A is a lateral side view of an outsole in accordance with certain aspects of this disclosure.
Figure 8B:
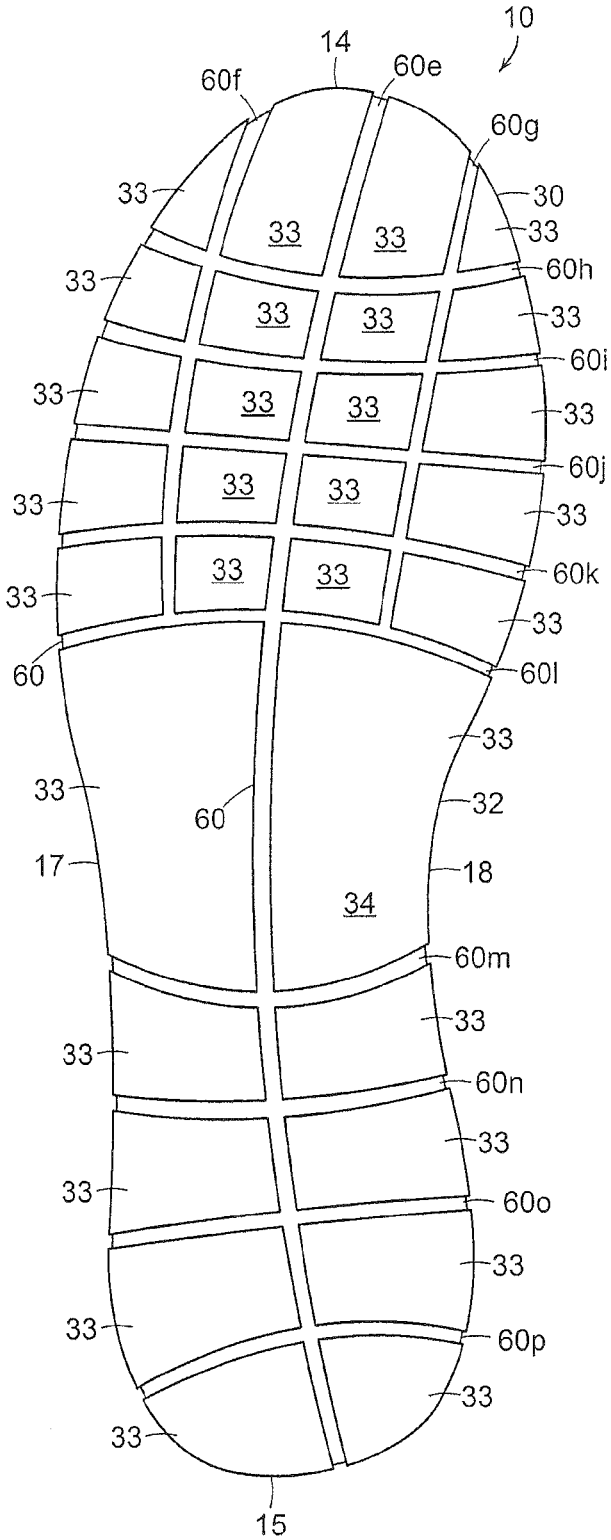
FIG. 8B is a bottom plan view of the outsole of FIG. 8A.

As shown in FIGS. 8A and 8B and according to one preferred embodiment of the disclosure, an outsole 30 has been provided with a plurality of channels 60 having openings that extend through the ground-contacting layer 32. Channel 60*e* extends longitudinally from back edge 15 to front edge 14. Two secondary longitudinally extending channels 60*f*, 60*g* are arranged on either side of channel 60*e* in the forefoot region of the outsole 30. A series of gently curved, transversely extending channels 60*h*-60*l* intersect the longitudinally extending channels 60*e*-60*g* in the forefoot region. At each of these intersections, the two intersecting channels extend continuously across the intersection. The intersecting channels 60 create an array of ground-contacting layer portions 33 that can move quasi-independently of one another. Another series of gently curved, transversely extending channels 60*m*-60*p* intersect the longitudinally extending channel 60*e* in the midfoot and heel regions of the outsole 30. These transversely extending channels are shown as extending completely across the width of the outsole 30, from the lateral edge 17 to the medial edge 18. Further, as is best shown in FIG. 8A, in this particular embodiment, the transversely extending channels 60*m*-60*p* in the midfoot and heel regions generally have a greater depth than the transversely extending channels 60*h*-60*l* in the forefoot region. In this embodiment, referring to FIG. 8B, the channels 60 are shown with substantially constant widths.

In the embodiment of FIGS. 8A and 8B, a channel 60, specifically channel 60*e*, extends longitudinally continuously from the back edge 15 to the front edge 14 of the outsole 30. Alternatively, according to some aspects, the outsole 30 does not need to include a channel 60 that extends continuously from the back edge to the front edge. This may be the case, even though the rib, within which the channel is formed, may extend continuously all the way from the back edge to the front edge. In other words, a channel formed within a rib may extend along the entire length of the rib or only along one or more portions of the rib. Alternatively, both the rib and the channel may extend only part of the distance from the back edge to the front edge.

Figure 9:
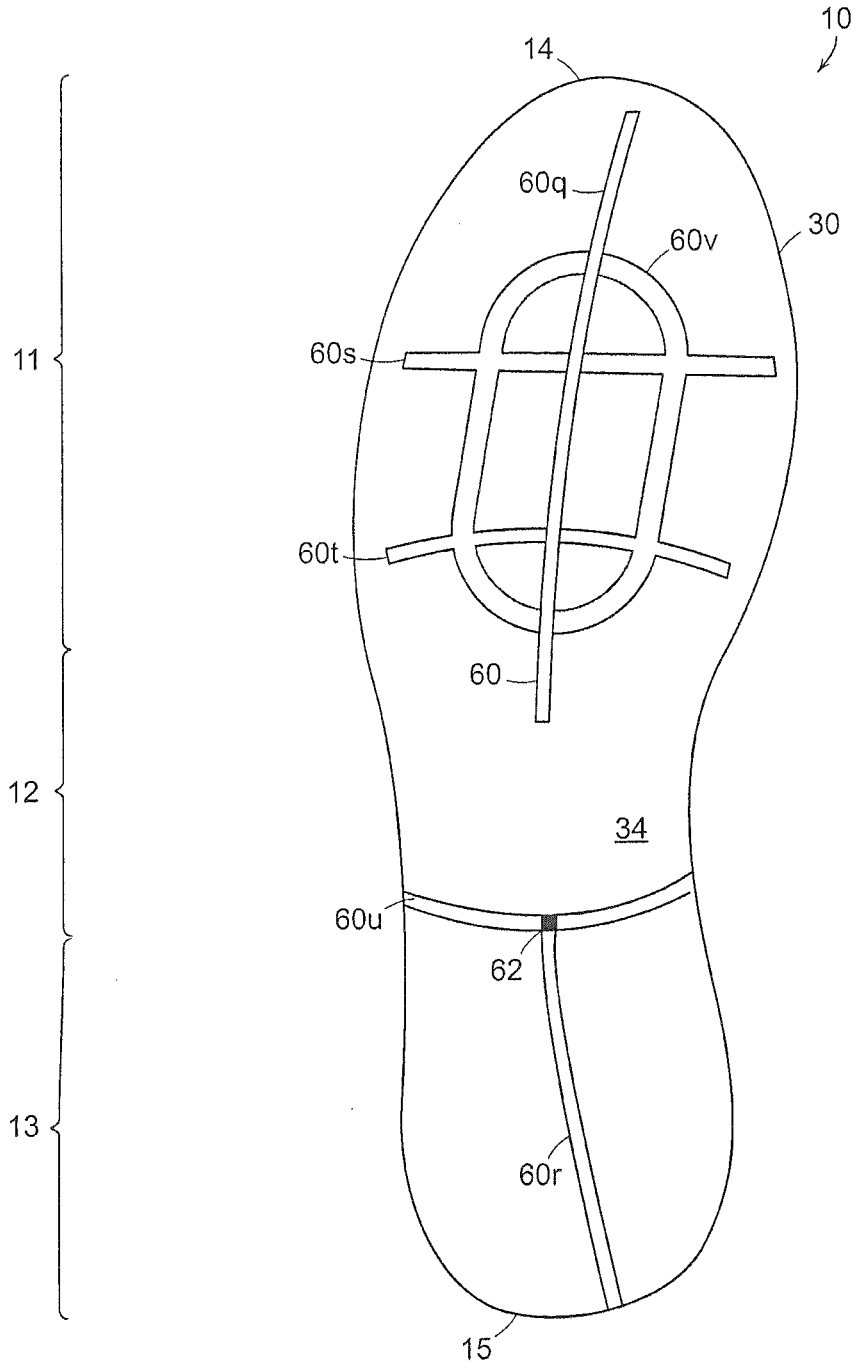
FIG. 9 is a bottom plan view of an outsole of an article of footwear in accordance with other aspects of this disclosure.

For example, outsole 30 may have a rib that extends for the entire distance from the back edge to the front edge of an article of footwear, but a channel that extends longitudinally only part of the distance from the back edge to the front edge. Thus, as best shown in FIG. 9, a first longitudinally extending channel 60*q* may be located within forefoot region 11 and partially extend into midfoot region 12. In this particular embodiment, this channel 60*q* stops short of the front edge 14 and does not extend within the rim region. Transversely oriented channels 60*s*, 60*t* intersect channel 60*q* in the forefoot region 11. These channels 60*s*, 60*t* also stop short of the outsole's perimeter and do not extend into the rim region. At the intersections of channel 60*q* with channels 60*s*, 60*t*, the longitudinally-oriented channel 60*q* extends continuously across the intersection, while the transversely-oriented channels 60*s*, 60*t* do not extend continuously across the intersections, i.e., the walls of channel 60*q* interrupt the transverse channels.

As another example, a second longitudinally extending channel 60*r* may be located within heel region 13. The second channel 60*r* is also shown extending partially into the midfoot region 12. A transversely oriented channel 60*u* intersects channel 60*r* in the midfoot region 11. In this particular example, at the intersection of channels 60*r* and 60*u*, a solid post 62 is formed, such that neither channel extends into the intersection.

Thus, referring to FIGS. 2 and 8B, it can be seen that, in certain embodiments, a channel 60 may extend over the entire longitudinal length of the article of footwear 100. Alternatively, a channel 60 may extend at least over the longitudinal length of the forefoot region 11. In even other alternative embodiments, as best shown on FIG. 9, a channel 60 may extend over a majority of the longitudinal length of the forefoot region 11. As another alternative, also shown in FIG. 9, a channel 60 may extend at least over the longitudinal length of the heel region 13. In even other alternative embodiments, a channel 60 may extend over more a majority of the longitudinal length of the heel region 13. With respect to channels that extend substantially in the transverse direction, in certain embodiments, a channel 60 may extend over the entire transverse width of the article of footwear 100. Alternatively, a channel 60 may extend at least over the transverse width of the lateral side 17*a* or of the medial side 18*a* or of both the lateral and the medial sides. In even other alternative embodiments, a channel 60 may extend over a majority of the transverse width of at least one of the lateral or medial sides.

Further, in FIG. 9, a substantially oval or race-track shaped channel 60*v* is located within the forefoot region 11, where it intersects the substantially longitudinally-oriented channel 60*q* and the substantially transversely-oriented channels 60*s*, 60*t*. Between the two transverse channels 60*s*, 60*r*, channel 60*v* is substantially longitudinally oriented. Where channel 60*v* intersects channel 60*q*, channel 60*v* is substantially transversely oriented. Thus, as shown and described, channels 60 (and associated ribs 50) may be linear, curvilinear, or composed of a combination of either linear or curvilinear segments.

Within limits, the greater the extent of any single channel 60, the more flexible the outsole 30 and the greater the amount of control that can be exercised by the wearer. Similarly, the greater the network of channels 60, the more flexible the outsole 30 and the greater the amount of control that can be exercised by the wearer. Furthermore, a network of channels 60, for example, as shown in FIGS. 8B and 9, may provide more capacity for flexing, such as upward cupping, of the center portion of the outsole 30. By varying the length, the thickness, the width, the material, and the placement of ribs 50 and by varying the length, the width, the depth and the placement of channels 60, the ultimate flexibility of the outsole 30 of the sole structure 10 may be tailored for specific sports and specific athletic styles.

While the invention has been described with respect to specific examples including presently preferred modes of carrying out the invention, those skilled in the art, given the benefit of this disclosure, will appreciate that there are numerous variations and permutations of the above described systems and techniques that fall within the spirit and scope of the invention as set forth above. Thus, for example, a wide variety of materials, having various properties, i.e., flexibility, hardness, durability, etc., may be used without departing from the invention. All examples, whether preceded by "for example," "such as," "including," or other itemizing terms, or followed by "etc.," are meant to be non-limiting examples, unless otherwise stated or obvious from the context of the specification.

We claim:

1. A sole structure for an article of footwear having a forefoot region, a midfoot region and a heel region, the sole structure comprising:

an outsole having a ground-contacting layer;

a first rib projecting upward from the ground-contacting layer and having side walls; and a channel defined by the side walls, the channel opening downward through the ground-contacting layer and having a depth extending above the ground-contacting layer;

wherein each of the first rib and the channel has a symmetric cross-section, and wherein the thicknesses of the side walls are non-constant.

2. The sole structure of claim 1, wherein the first rib is located in at least one of the forefoot region and the heel region.

3. The sole structure of claim 1, wherein the channel extends along at least a majority of the length of the first rib.

4. The sole structure of claim 1, wherein the channel extends along the entire length of the first rib.

5. The sole structure of claim 1, wherein the first rib extends in a generally heel-to-toe direction.

6. The sole structure of claim 1, further including a plurality of intersecting ribs, a plurality of channels, and a plurality of ground-contacting portions between adjacent channels.

7. The sole structure of claim 1, wherein at least a portion of the channel has a channel depth that is at least 1.5 times the thickness of the ground-contacting layer.

8. The sole structure of claim 1, wherein the first rib further includes an end wall and at least one projection extends from a side wall of the first rib upward, beyond a top surface of the end wall.

9. The sole structure of claim 1, wherein the first rib further includes an end wall and one or more projections extending upward above a top surface of the end wall, and wherein the compressive stiffness of the one or more projections is less than the compressive stiffness of the side walls.

10. The sole structure of claim 1, further including:

a second rib projecting upward from the ground-contacting layer and extending in a generally transverse direction and having side walls; and a second channel defined by the side walls of the second rib, the second channel opening downward through the ground-contacting layer and having a depth extending above the ground-contacting layer.

11. The sole structure of claim 1, wherein the first rib further includes an end wall, and wherein a minimum thickness of the end wall is less than a minimum thickness of the side walls.

12. The sole structure of claim 1, wherein a thickness of the side walls is greater than a thickness of the ground-contacting layer.

13. The sole structure of claim 1, further including a midsole secured to the outsole such that the first rib transmits compressive loads from the midsole to the ground-contacting layer.

14. The sole structure of claim 1, wherein a height of the rib in a first region is greater than the height of the rib in a second region.

15. The sole structure of claim 1, wherein the first rib is freestanding, such that a majority of a side wall area of the rib is unsupported.

16. The sole structure of claim 1, wherein the first rib has a first material at the top of the rib and a second, different, material at the bottom of the rib, the second material having a greater modulus of elasticity than the first material.

17. A sole structure for an article of footwear, the sole structure comprising:

an outsole having a ground-contacting layer;

a first rib projecting upward from the ground-contacting layer, the first rib having side walls extending upward from the ground-contacting layer and an end wall extending between the side walls; and a channel defined within the first rib, the channel opening downward through the ground-contacting layer;

wherein the first rib has a rib height that is greater than a rib width, and wherein the first rib has a first material at the top of the rib and a second, different, material at the bottom of the rib.

18. The sole structure of claim 17, wherein second material has a greater modulus of elasticity than the first material.

19. The sole structure of claim 17, wherein at least one projection extends upward from a side wall of the rib beyond a top surface of the end wall of the rib.

20. The sole structure of claim 17, wherein the first rib further includes an end wall and one or more projections extending upward above a top surface of the end wall, and wherein the compressive stiffness of the one or more projections is less than the compressive stiffness of the side walls.

* * * * *